US005533248A

United States Patent [19]

Tippins et al.

[11] Patent Number: 5,533,248

[45] Date of Patent: Jul. 9, 1996

[54] METHOD OF STEEL PROCESSING USING AN INLINE GRINDER

[75] Inventors: George W. Tippins; John E. Thomas; William H. Tippins, all of Pittsburgh; Ronald D. Gretz, Brackenridge, all of Pa.

[73] Assignee: Tippins Incorporated, Pittsburgh, Pa.

[21] Appl. No.: 371,399

[22] Filed: Jan. 11, 1995

Related U.S. Application Data

[63] Continuation-in-part of Ser. No. 123,149, Sep. 20, 1993, which is a continuation of Ser. No. 881,615, May 12, 1992, Pat. No. 5,276,952.

[51] Int. Cl.[6] ..... B21B 1/00

[52] U.S. Cl. ..... 29/527.7; 29/33 C; 29/DIG. 5; 72/202; 72/229

[58] Field of Search ..... 29/527.7, 33 C, 29/DIG. 5; 72/700, 202, 229

[56] References Cited

U.S. PATENT DOCUMENTS

| | | | |
|---|---|---|---|
| 1,841,297 | 1/1932 | Perry et al. . | |
| 3,331,123 | 7/1967 | Cofer | 29/528 |
| 3,610,315 | 10/1971 | Juergens et al. | 164/76 |
| 4,229,878 | 10/1980 | Ushijima | 29/527.7 |
| 4,503,697 | 3/1985 | Tippins et al. | 72/202 |
| 4,532,980 | 8/1985 | Miyawaki et al. | 164/475 |
| 4,630,352 | 12/1986 | Ginzburg et al. | 29/527.7 |
| 4,698,897 | 10/1987 | Frommann et al. | 29/527.7 |
| 4,793,169 | 12/1988 | Ginzburg | 72/240 |
| 4,958,677 | 9/1990 | Kimura | 164/452 |
| 5,150,597 | 9/1992 | Sekiya et al. | 72/229 |
| 5,286,315 | 2/1994 | Iwayama et al. | 148/538 |

OTHER PUBLICATIONS

Danieli Centro Maskin, "In–Line Conditioning Plant For Slab Casters", Jun. 15, 1994.

Grubbauer, Karl, et al., "Revamping potential in the finishing shop of slab caster facilities" (7 pages), Feb. 20, 1992.

*Primary Examiner*—Carl J. Arbes

*Attorney, Agent, or Firm*—Webb Ziesenheim Bruening Logsdon Orkin & Hanson

[57] ABSTRACT

A method and apparatus of making coiled plate, sheet in coiled form or discrete plate. The apparatus is a slab caster and inline surface conditioner, hot strip and plate line. The apparatus includes a continuous strip caster forming a strand; a cutoff for cutting the strand into a slab of desired length; a slab conveyor table; a slab conditioning device inline with the slab conveyor table adapted to selectively receive slabs therefrom; a reheat furnace having an entry inline with the slab conveyor table; a feed and run back table at the exit of the reheat furnace; a single or twin stand hot reversing mill for reducing the slab to a coiling thickness; and a pair of coiler furnaces located on opposite sides of the hot reversing mill.

20 Claims, 3 Drawing Sheets

METHOD OF STEEL PROCESSING USING AN INLINE GRINDER

This is a continuation-in-part of U.S. patent application Ser. No. 08/123,149, filed on Sept. 20, 1993, which is a continuation of U.S. patent application Ser. No. 07/881,615, filed on May 12, 1992, now U.S. Pat. No. 5,276,952.

FIELD OF THE INVENTION

This invention relates to the continuous casting and rolling of slabs with inline surface processing and more particularly to an integrated intermediate thickness caster, inline surface grinder and a hot reversing mill.

BACKGROUND OF THE INVENTION

Since the advent of the continuous casting of slabs, the steel industry has tried to successfully combine the hot strip mill and the continuous caster through an inline arrangement so as to maximize production capability and minimize the equipment and capital investment required. The efforts in this regard and shortcomings thereof are discussed in parent application Ser. No. 08/123,149 which is incorporated herein by reference.

Presently, in integrated thick slab mills, surface critical steels are taken off-line at the exit of the continuous caster to a surface conditioning area to improve and upgrade the metal surface. The slab is allowed to cool prior to surface conditioning which results in significant energy losses and changes in the slab metallurgy. This diversion also increases in-process inventory and handling costs.

It is an object of our invention to integrate an intermediate thickness slab caster with inline surface processing and a hot reversing mill which balances the rate of the caster with the rate of the rolling mill. It is also an object of our invention to adopt a system using less thermal and electrical energy and which minimizes or eliminates the need to take slabs off-line. It is still a further object to adopt an automated system with small capital investment, reasonable floor space requirements, reasonably powered rolling equipment and low operating costs.

SUMMARY OF THE INVENTION

Our invention provides for a versatile integrated caster and minimill which can produce product 24 inches to 120 inches wide of 1,000 PIW. This is accomplished using a casting facility having a fixed and adjustable width mold with a straight rectangular cross section without the trumpet type mold. The caster has a mold which contains enough liquid volume to provide sufficient time to make flying tundish changes, thereby not limiting the caster run to a single tundish life. Our invention provides a caster which can operate at conventional caster speeds and conventional descaling techniques. Our invention provides for the selection of the optimum thickness cast slab to be used in conjunction with a hot reversing mill providing a balanced production capability. In addition, our invention provides for the easy surface conditioning of slabs which require conditioning such as nonuniform slabs formed when molten metal chemistry changes or width changes are made in the caster which disrupt short-term, steady state operations.

All of the above advantages are realized while preferably maintaining the advantages of a thin slab caster which include low ferrostatic head, low weight of slab, straight molds, shorter length molds, smaller required mold radius, low cooling requirements, low burning costs or shear capacity and simplified machine constructions.

Our invention provides a slab caster, preferably for intermediate thickness slabs, integrated with a hot strip and plate line which includes a reheat or equalizing furnace capable of receiving slabs directly from the caster and an inline slab conditioning area positioned adjacent the slab conveyor table exiting the continuous caster or from another area. A feed and run out table is positioned at the exit end of the reheat furnace and inline with a one or two stand hot reversing mill having a coiler furnace positioned on either side thereof. The combination coil, coiled plate, sheet in coil form or discrete plate finishing line extends inline and downstream of the hot reversing mill with its integral coiler furnaces. A finishing facility may be provided which includes a cooling station, a downcoiler, a plate table, a shear, a cooling bed crossover, a plate side and end shear and a piler.

To achieve the necessary balance between the hot reversing mill and the caster, it is necessary to produce slabs having an intermediate thickness. The slabs are reduced to about 1 inch or less on the hot reversing mill before starting the coiling of the intermediate product between the coiler furnaces as they are further reduced to the desired finished product thickness. In order to provide the capability of making coiled plate, discrete plate and sheet in coil form up to 1,000 PIW and higher, slab width may vary from 24 to 120 inches.

A preferred method of operation includes feeding a sheared or torch cut slab from the caster onto a slab table which either feeds directly into a reheat or equalizing furnace or into an inline slab conditioning area adjacent to the slab table.

DESCRIPTION OF THE PREFERRED EMBODIMENTS

Figure 1:
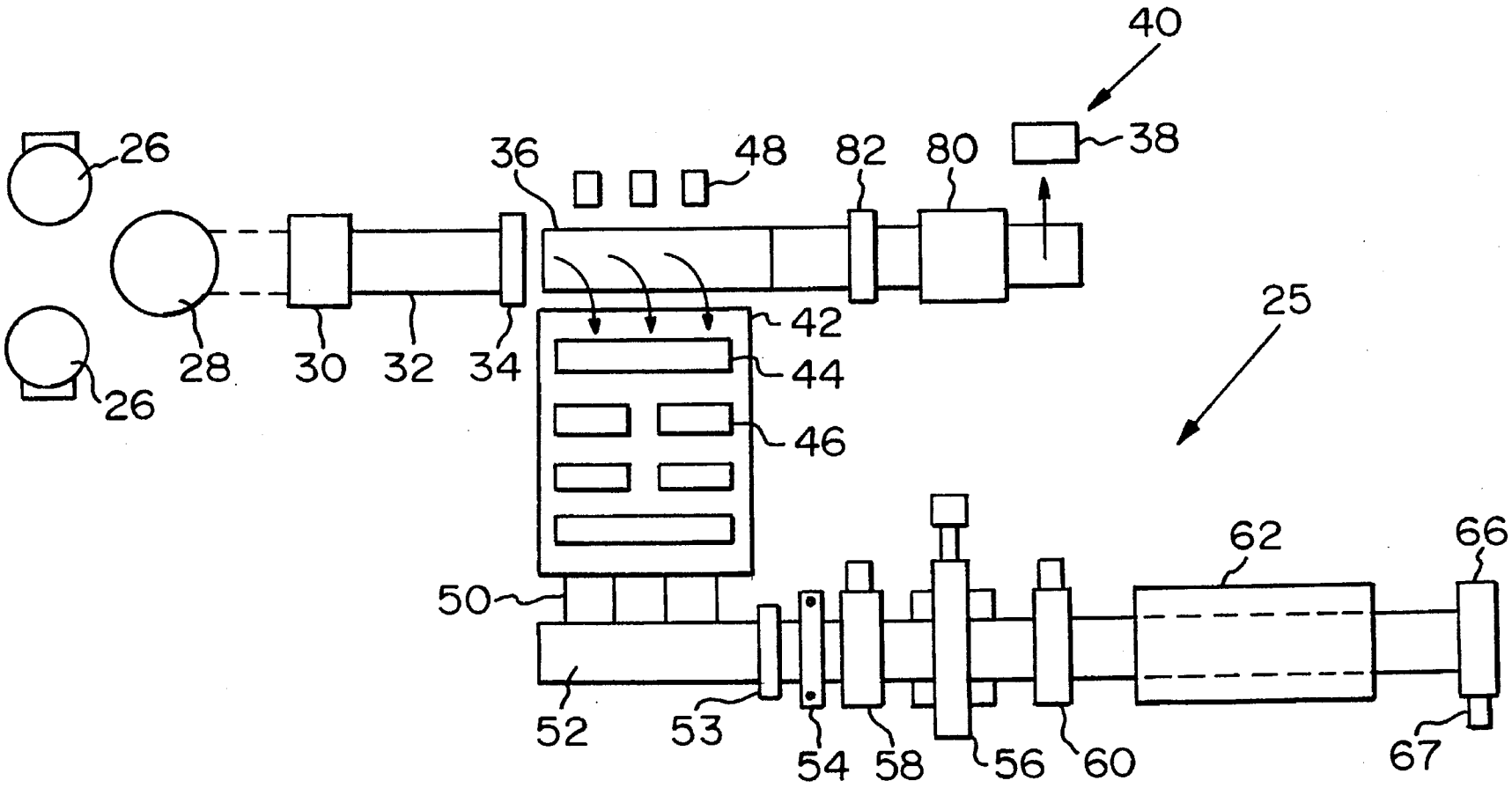
FIG. 1 is a schematic illustrating the intermediate thickness strip caster and inline surface conditioning, hot reversing mill and coiler furnace arrangement according to a first embodiment of the present invention.
Figure 2:
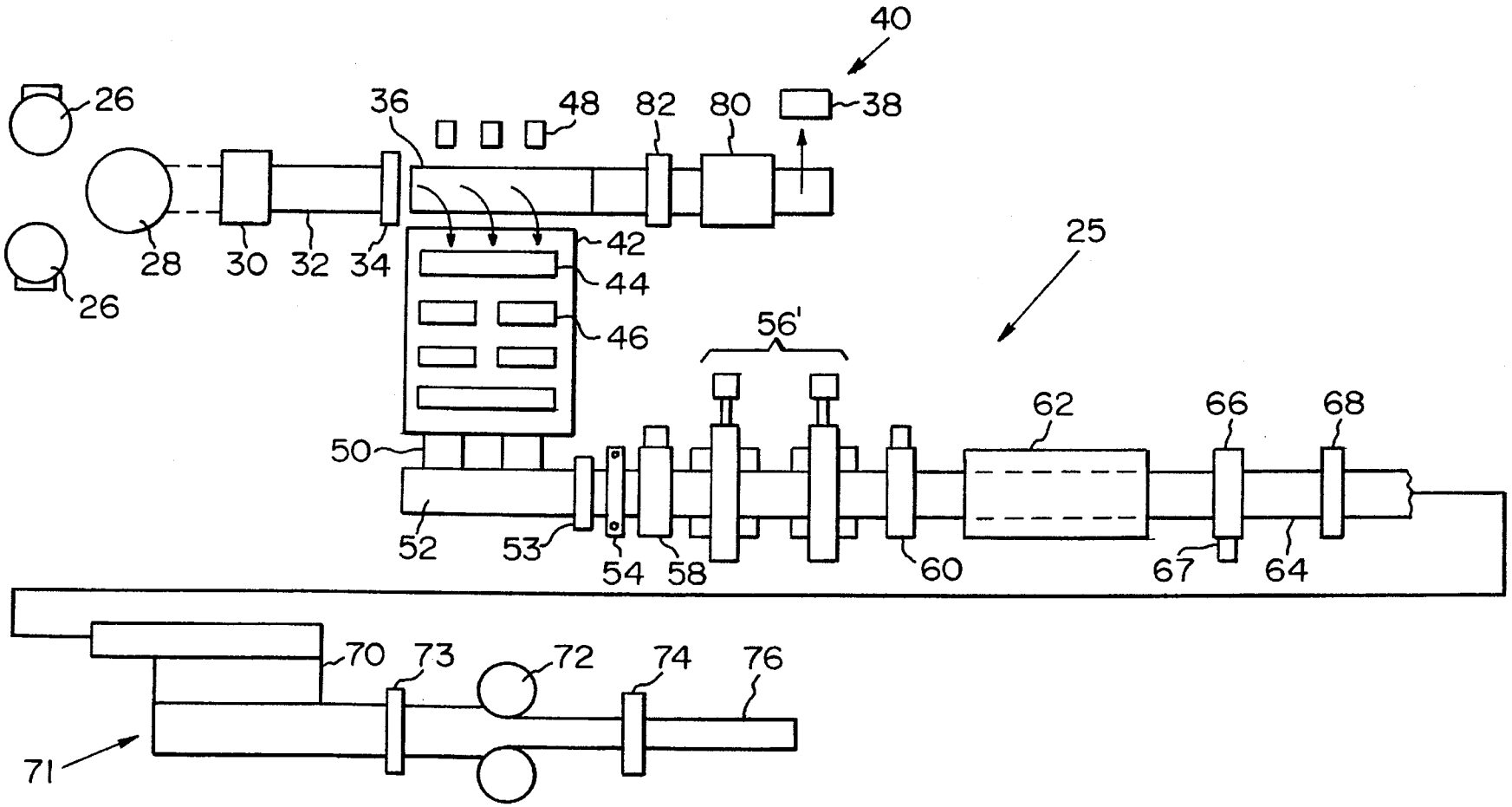
FIG. 2 is a schematic illustrating the intermediate thickness strip caster and inline surface conditioning, hot reversing mill and coiler furnace arrangement according to a second embodiment of the present invention.

The intermediate thickness slab caster with inline surface conditioning and inline hot strip and plate line of the present invention is illustrated in FIGS. 1 and 2. One or more electric melting furnaces 26 provides the molten metal at the entry end of our combination caster and strip and plate line 25. The molten metal is fed into a ladle furnace 28 prior to being fed into the caster 30. The caster 30 feeds into a mold (curved or straight) 32 of rectangular cross section.

A torch cutoff or shear 34 is positioned at the exit end of the mold 32 to cut the strand of now solidified metal slab of preferably intermediate thickness of the desired length which also has a width of 24 to 120 inches. Within the context of steels requiring a significant amount of surface processing, intermediate thickness generally refers to about 3½ to about 8 inches.

The slab then feeds on a table conveyor 36 to a slab takeoff area where it is directly charged into a furnace 42 or sent to inline slab grinder 80 and slab turnover 82 for surface conditioning. The slab may be removed from the inline processing and stored in a slab storage area 40 to accommodate production delays, such as a delay downstream. However, inline slab grinder 80 significantly reduces the need to take slabs off-line and eliminates the need for an off-line slab conditioning area traditionally found in a slab yard, such as slab storage area 40. Therefore, slab storage area 40 is significantly smaller than a conventional slab yard and may even be deleted. The preferred furnace is of the walking beam type although a walking hearth furnace could also be utilized in certain applications. Full-size slabs 44 and discrete length slabs 46 for certain plate products are shown within walking beam furnace 42. Slabs 38, which are located in the slab storage area 40, may also be fed onto the table conveyor 36 and then into the furnace 42 by means of slab pushers 48, or by charging arm devices located for indirect charging of walking beam furnace 42 with slabs 38. It is also possible to charge slabs from other slab yards or storage areas. Because the intermediate thickness slabs retain heat to a much greater extent than the thin slabs and because with slab grinder 80 slabs are generally not taken off-line, temperature equalization is all that is required in many modes of operation. Of course, where slabs 38 are introduced from off-line locations, the furnace must have the capacity to add Btu's to bring the slabs up to rolling temperatures.

The various slabs are fed through the furnace 42 in a conventional manner and are removed by slab extractors 50 and placed on a feed and run back table 52. High-pressure descaler 53 and/or a vertical edger 54 can be utilized on the slabs. A vertical edger normally could not be used with a slab of only 2 inches or less in thickness due to buckling.

Downstream of feed and run back table 52 and vertical edger 54 is a single stand hot reversing mill 56 (FIG. 1) or twin stand hot reversing mill 56' (FIG. 2) having an upstream and a downstream coiler furnace 58 and 60, respectively. The twin stand hot reversing mill 56' increases rolling capacity which becomes more important with the type and thickness of slabs associated with a greater degree of surface conditioning. Cooling station 62 is downstream of coiler furnace 60. Downstream of cooling station 62 is a coiler 66 operated in conjunction with a coil car 67 and may be followed by a plate table 64 operated in conjunction with a shear 68, as shown in FIG. 2. The final product is either coiled on coiler 66 and removed by coil car 67 as sheet in strip or coil plate form or, if provided, is sheared into plate form for further processing inline. As shown in FIG. 2, a plate product may be transferred by transfer table 70 which includes a cooling bed onto a final processing line 71. The final processing line 71 includes a plate side shear 72, plate end shear 74 and plate piler 76. The downstream processing is not critical to this particular improvement and the downstream processing set forth in the parent application is exemplary of the downstream processes which can be employed.

Figure 3:
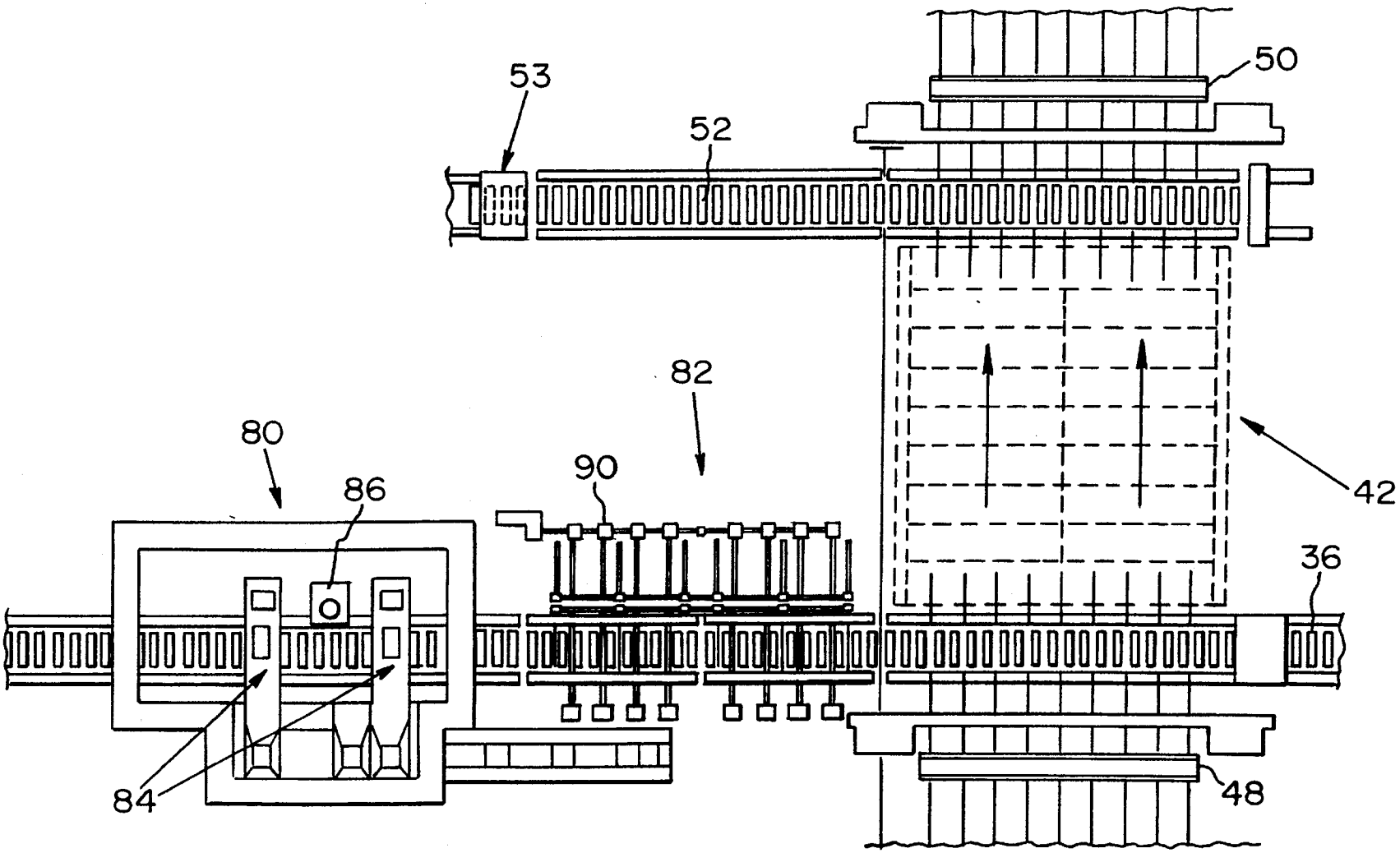
FIG. 3 is a further detailed schematic illustrating the inline surface conditioning shown in FIGS. 1 and 2.

The surface conditioning unit of the present invention is shown in more detail in FIG. 3. The inline slab grinder 80 automatically performs hot surface conditioning with a pair of surface grinding machines 84 in a fixed location. An edge grinder 86 may be provided for grinding one edge of a slab and, depending on the operation of slab turnover 82, another edge grinder may or may not be positioned on the opposite side of the slab. In general, the slab will typically be at a mean body temperature of at least 1,500° F. during grinding. The as-cast slab will normally be at a mean body minimum temperature of at least 900° F to assure a proper slab microstructure. This then defines a typical floor temperature for hot grinding. It will be understood by those skilled in the art that grinding can also be carried out at ambient temperatures with a resultant decrease in throughput. A slab selected for surface conditioning moves back and forth through the hot slab grinding machine and is indexed along the width direction until an entire slab surface is processed. The selected slab is turned by slab turnover 82 and the process is repeated for the other side. Slab turnover 82 is a conventional slab turning device, such as slab manipulator 90 shown in FIG. 3. The slab turnover 82 is required because known hot slab grinders presently only contain the ability to hot grind one slab surface at a time. As advances in the art allow for hot grinding of both surfaces of the slab, the slab turnover 82 can be eliminated.

With the present invention, the total conditioning time for a 60 inch wide by 60 foot long slab is typically 18 minutes. This permits 100% grinding to synchronize with a process throughput of 100 tons per hour; however, it is not likely that every slab will require surface processing. Optionally, additional grinding machines could be added to raise a process throughput appropriately.

The present arrangement is designed to effectively eliminate the requirement for shipping slabs off-line in the integrated caster and rolling mill. The advantages of the present system will be highlighted in reviewing current casting technology. Even with proper control of casting technology, a significant percentage of the slabs cast will need surface conditioning where the application involves surface critical steel quality. The present invention allows these slabs to be processed inline, allowing the maintenance of the desired quality for nearly all of the slabs. Additionally, in certain product grades, such as low carbon steels with moderate finished product surface requirements, only the first and last slabs of the particular casting sequence may need surface conditioning. Conversely, other grades such as stainless steel historically required a high percentage of surface conditioning.

The surface process according to the present invention is intended to be automated whereby the slabs are scanned or visually inspected to determine which slabs require further conditioning by hot grinding. The present arrangement of inline slab grinder 80 is only economically reasonable where a certain percentage of the slabs will be expected to require surface conditioning, such as in stainless steels or high strength, low alloy steels.

In addition to the inline advantages of surface conditioning discussed above, hot grinding provides additional benefits over cold grinding. In view of the elevated temperatures of the slab being worked, a slab defect may more easily appear to the unaided eye. For example, a crack would appear as a bright spot on the surface relative to the immediate surrounding area. This is because the normal surface emissivity of oxidized steel is 0.6 to 0.8, but a defect cavity acts like a perfect blackbody with an emissivity of 1; therefore, it will radiate more and appear as a bright area. Consequently, when the surface is hot, the crack will show up better and will be more readily resolved visually or with an optical scanner allowing more precise grinding of the slabs providing for a yield savings due to reduced surface conditioning of non-defect areas.

The inline surface conditioning according to the present invention provides a significant energy savings due to an increase in the hot charging provided. Significant space savings is provided by the compact arrangement of the present layout. Specifically, the area of the conventional slab yard is significantly reduced since the slab cooling and surface conditioning aspects of the slab yard have been completely eliminated. The present invention provides for improved slab metallurgical structure of those slabs which would previously have been taken off-line due to the elimination of the cooling and reheating which adversely affect the grain structure. Furthermore, this improved slab metallurgical structure allows for easier rolling than a slab which has gone through cooling and reheating cycles. The present invention also provides an ability to integrate the system with an oxidizing style furnace which can readily burn out defects to reduce the need for surface grinding. This then provides for a plurality of surface conditioning techniques, namely, hot grinding, furnace oxidizing and high-pressure descaling which can be used separately or in combination to optimize the surface quality of the slab being processed. The individual grinding machines experience an improved grinder life and faster removal rates when operated on work products at high temperatures such as the hot slabs in the present invention.

As discussed above, a 60 foot cast intermediate thickness slab would require a total slab grinding time of about 18 minutes, including transportation and turnover time. Considering casting facilities in general, the typical 1,000 PIW slab thicknesses will fall into the following ranges: a thin slab of 2 to 3 inches in thickness having a length of 150 to 100 feet; a general intermediate slab having a thickness of 3½ to 6 inches and a corresponding length of 84 to 54 feet; an intermediate stainless steel slab having a cast thickness of 6 to 8 inches with a length of 48 to 36 feet; and a thick steel slab having a thickness generally of 8 to 10 inches and a length of 36 to 30 feet.

The slab thickness is not critical to the process described according to the present invention. The present process is applicable to all slab thicknesses. For example, a slab on the order of 60 feet in length, which would imply a thickness of 4.9 inches for 1,000 PIW would provide a total slab weight of 60,000 pounds. Obviously, a slab shorter than 60 feet could also be handled without modification. Two 10 inch thick slabs of 30 feet in length could be processed independently or simultaneously. Slabs longer than 60 feet may require modification of the present design in order to accept the length. However, grinding of slabs above 85 feet in length becomes somewhat cumbersome and unproductive due to increased yield loss due to increase in ground surface area. Slab lengths shorter than 30 feet are also possible. The upper limit on a slab thickness of the present invention is approximately 12 inches. However, modifications to the present invention may be provided to permit even thicker slabs to be ground on the present machine, such as in an ingot or bloom production facility.

From the present disclosure, it will be apparent to those of ordinary skill in the art that various modifications may be made to the present invention without departing from the spirit and scope thereof. Consequently, the present invention is intended to be defined by the attached claims.

What is claimed is:

1. A method of steel processing comprising the steps of:

a) continuously casting a strand;

b) cutting said strand into a plurality of slabs of predetermined lengths;

c) inspecting each slab to select some of the plurality of slabs which require surface conditioning;

d) surface conditioning the selected some of the plurality of slabs which require surface conditioning, said surface conditioning performed at a position inline with said caster;

e) feeding each slab into an inline heating furnace after said steps of inspecting and surface conditioning;

f) extracting each slab onto a continuous processing line including a hot rolling mill.

2. The method of claim 1 wherein said hot rolling mill is a hot reversing mill having a coiler furnace on each of an upstream side and downstream side thereof and further including the steps of:

f) flat passing each slab back and forth through said mill to form an intermediate product of a thickness sufficient for coiling;

g) passing said intermediate product through the mill to further reduce its thickness and coiling said intermediate product in one of said upstream or downstream coiler furnaces; and h) passing said coiled intermediate product back and forth through said mill to reduce said coiled intermediate product to an end product of desired thickness, said intermediate product being collected in and fed out of each of said coiler furnaces on each pass through the mill.

3. The method of claim 2 further comprising the step of passing said slab through a vertical edger in conjunction with flat passing said slab.

4. The method of claim 2 including reducing said intermediate product to said end product in six or less passes through said hot reversing mill.

5. The method of claim 2 wherein said finishing of said end product includes cooling said end product by passing it through an inline cooling station and thereafter coiling it on an inline coiler for removal as coiled plate or sheet in coil form.

6. The method of claim 2 wherein said finishing of said end product includes shearing inline to a plate of a discrete length, cooling said plate and finishing said plate through at least one of a side shear and end shear and a piler.

7. The method of claim 1 wherein said strand is less than 12 inches thick.

8. The method of claim 1 including casting said strand to an intermediate thickness.

9. The method of claim 4 including casting said strand to an intermediate thickness of between 3.5 and 6 inches.

10. The method of claim 1 including casting a strand having a width between 24 inches and 120 inches.

11. The method of claim 1 wherein said surface conditioning includes hot surface grinding of said selective slabs.

12. A method of steel processing comprising the steps of:

a) continuously casting a strand;

b) cutting said strand into a plurality of slabs of predetermined lengths;

c) selectively surface conditioning some of the plurality of slabs which require surface conditioning, said surface conditioning performed at a position inline with said caster, said surface conditioning includes hot surface grinding of said selected slabs, wherein said hot surface grinding includes the steps of hot grinding a first surface of a selected slab, turning said selected slab over and hot grinding a second surface of said selected slab;

d) feeding the slabs into an inline heating furnace;

e) extracting each slab onto a continuous processing line including a hot rolling mill.

13. The method of claim 1 including surface conditioning at a location downstream of an entrance to said inline heating furnace whereby a conditioned slab is returned to said entrance.

14. The method of claim 12 further comprising the step of inspecting each slab prior to surface conditioning to determine the slabs which require surface conditioning.

15. The method of claim 12 including casting said strand to an intermediate thickness of between about 3.5 and 6 inches.

16. A method of steel processing comprising the steps of:

a) continuously casting a strand;

b) cutting said strand into a plurality of slabs of predetermined lengths;

c) selectively hot surface grinding some of the plurality of slabs which require surface conditioning, said hot surface grinding performed at a position inline with said caster;

d) feeding each slab into an inline heating furnace;

e) extracting each slab onto a continuous processing line including a hot rolling mill.

17. The method of claim 16 further including the step of inspecting each slab prior to said selective hot surface grinding to select some of the plurality of slabs which require surface conditioning by hot surface grinding.

18. The method of claim 16 wherein each of the slabs which require surface conditioning will have a mean body minimum temperature of at least 900° F. during said hot surface grinding and said step of feeding each slab into an inline heating furnace is performed after said selective hot surface grinding of each slab.

19. The method of claim 16 including casting said strand to an intermediate thickness.

20. The method of claim 16 including casting said strand to an intermediate thickness of between about 3.5 and 6 inches.

* * * * *

UNITED STATES PATENT AND TRADEMARK OFFICE

CERTIFICATE OF CORRECTION

PATENT NO. : 5,533,248

DATED : July 9, 1996

INVENTOR(S) : George W. Tippins, John E. Thomas, William H. Tippins and Ronald D. Gretz It is certified that error appears in the above-indentified patent and that said Letters Patent is hereby corrected as shown below:

Claim 2 Line 11 Column 6 "f)" should read --g)--.

Claim 2 Line 14 Column 6 "g)" should read --h)--.

Claim 2 Line 18 Column 6 "h)" should read --i)--.

Signed and Sealed this

Twenty-fourth Day of September, 1996

*Attest:*

Bruce Lehman

BRUCE LEHMAN

*Attesting Officer*

*Commissioner of Patents and Trademarks*